US011286702B2

(12) United States Patent
Krushel et al.

(10) Patent No.: US 11,286,702 B2
(45) Date of Patent: Mar. 29, 2022

(54) POWER DRIVE MODULE FOR VEHICLE DOORS

(71) Applicant: Multimatic Inc., Markham (CA)

(72) Inventors: Kelsey Dale Krushel, Uxbridge (CA); Balathas Nagamany, Markham (CA); Victor Gusev, Richmond Hill (CA); Andrew Peter Marangoni, Toronto (CA)

(73) Assignee: Multimatic Inc., Markham (CA)

( * ) Notice: Subject to any disclaimer, the term of this patent is extended or adjusted under 35 U.S.C. 154(b) by 134 days.

(21) Appl. No.: 16/638,332

(22) PCT Filed: Sep. 7, 2018

(86) PCT No.: PCT/US2018/049878
§ 371 (c)(1),
(2) Date: Feb. 11, 2020

(87) PCT Pub. No.: WO2019/055299
PCT Pub. Date: Mar. 21, 2019

(65) Prior Publication Data

US 2020/0224480 A1 Jul. 16, 2020

Related U.S. Application Data

(60) Provisional application No. 62/557,951, filed on Sep. 13, 2017.

(51) Int. Cl.
*E05F 11/24* (2006.01)
*E05F 15/622* (2015.01)

(52) U.S. Cl.
CPC ..... *E05F 15/622* (2015.01); *E05Y 2201/21* (2013.01); *E05Y 2201/49* (2013.01); *E05Y 2900/531* (2013.01)

(58) Field of Classification Search
CPC ..... E05F 15/122; E05F 15/18; E05F 15/649; E05F 15/616; E05F 15/603; E05F 15/611;
(Continued)

(56) References Cited

U.S. PATENT DOCUMENTS 3,141,662 A 7/1964 Wise
4,121,382 A * 10/1978 Dietrich ..... E05F 15/614 49/280

(Continued)

FOREIGN PATENT DOCUMENTS

CN 2367730 Y 3/2000
CN 2535261 Y 2/2003

(Continued)

OTHER PUBLICATIONS

Indian Examination Report for Indian Application No. 202017011215 dated Dec. 30, 2020.

(Continued)

*Primary Examiner* — Chi Q Nguyen
(74) *Attorney, Agent, or Firm* — Carlson, Gaskey & Olds, P.C.

(57) ABSTRACT

A power drive module for a vehicle power door includes a housing, a drive mechanism arranged in the housing and configured to move a drive element, and a brake assembly arranged in the housing. The brake assembly includes a brake ring operatively coupled to the drive mechanism. A brake band is wrapped about the brake ring and movable between a normally engaged position relative to the brake ring and a disengaged position relative to the brake ring. A brake release actuator is operatively connected to the brake band and configured to move the brake band between the engaged and disengaged positions with the brake ring in response to an electrical signal.

21 Claims, 9 Drawing Sheets

(58) Field of Classification Search
CPC .. E05F 15/622; E05F 15/614; E05Y 2201/21; E05Y 2201/49; E05Y 2900/531; B60J 5/0413; B60J 5/04; B60J 5/0472
USPC ..... 49/352, 343, 349, 358, 333, 334, 340, 49/339, 280, 287
See application file for complete search history.

(56) References Cited

U.S. PATENT DOCUMENTS

| | | | | |
|---|---|---|---|---|
| 5,341,598 | A | 8/1994 | Reddy | |
| 7,573,171 | B2 * | 8/2009 | Sesita | H02K 7/106 310/180 |
| 7,856,759 | B2 * | 12/2010 | Elliott | E05D 15/58 49/358 |
| 7,928,678 | B2 * | 4/2011 | Imai | E05F 15/662 318/468 |
| 8,407,940 | B2 * | 4/2013 | Ishida | E05F 15/646 49/352 |
| 9,260,901 | B2 * | 2/2016 | Ishida | E05F 15/632 |
| 9,995,356 | B2 | 6/2018 | Pizzio et al. | |
| 10,352,080 | B2 * | 7/2019 | Rietdijk | E05F 3/16 |
| 10,612,288 | B2 * | 4/2020 | Rietdijk | E05F 15/627 |
| 10,633,906 | B2 * | 4/2020 | Rietdijk | B60J 5/0468 |
| 2005/0067990 | A1 * | 3/2005 | Matsui | E05F 15/70 318/478 |
| 2009/0217596 | A1 * | 9/2009 | Neundorf | E05B 81/20 49/506 |
| 2010/0243294 | A1 * | 9/2010 | Ayme | H02G 3/22 174/153 R |
| 2012/0049709 | A1 | 3/2012 | Scheffknecht et al. | |
| 2014/0005842 | A1 | 1/2014 | Burris et al. | |
| 2014/0224045 | A1 | 8/2014 | Kummer | |
| 2015/0096233 | A1 * | 4/2015 | Kojima | E05F 15/40 49/31 |
| 2018/0209194 | A1 | 7/2018 | Rietdijk | |

FOREIGN PATENT DOCUMENTS

| | | | |
|---|---|---|---|
| CN | 201351424 | Y | 11/2009 |
| CN | 203374119 | U | 1/2014 |
| GB | 872577 | A | 7/1961 |
| GB | 1318550 | A | 5/1973 |
| JP | H02229378 | A | 9/1990 |
| WO | 2006084740 | A1 | 8/2006 |
| WO | 2016133873 | A1 | 8/2016 |
| WO | 2016164023 | A1 | 10/2016 |
| WO | 2017029262 | A1 | 2/2017 |

OTHER PUBLICATIONS

Russian Office Action for Russian Application No. 2020112343 dated Jul. 21, 2020.
International Search Report and Written Opinion for International Application No. PCT/US2018/049878 dated Nov. 22, 2018.
International Preliminary Report on Patentability for International Application No. PCT/US2018/049878 dated Nov. 28, 2019.
Chinese Office Action for Chinese Patent Application No. 201880057874.7 dated May 27, 2021.

* cited by examiner

POWER DRIVE MODULE FOR VEHICLE DOORS

CROSS-REFERENCE TO RELATED APPLICATIONS

This application is a United States National Phase Application of PCT Application No. PCT/US2018/049878 filed Sep. 7, 2018, which claims priority to U.S. Provisional Application No. 62/557,951 which was filed on Sep. 13, 2017, and is incorporated herein by reference.

BACKGROUND

This disclosure relates to an automated door for a vehicle, and more particularly, for a vehicle passenger door.

Increasingly power doors are being provided on vehicles, such as a rear liftgate to a cargo area of a sport utility vehicle or a sliding door on one or both sides of a minivan. A power drive module moves the liftgate or sliding door between opened and closed positions in response to an input from an electrical switch.

Typically, a passenger door is manually opened or closed by pushing or pulling on the door without the benefit of a power drive module. Passenger doors are conventionally held opened and closed using a door check. A passenger pushes a button or engages a handle which unlatches the door from the vehicle frame. The door check is interconnected between the frame and the door. The door check typically includes detents that define discrete door open positions, which hold the door open.

Power drive modules have been applied to passenger doors, but these modules are rather complex. For example, a motor is used to selectively drive gears through a clutch, which opens and closes to couple and decouple the motor. Prior art power door modules have been described in U.S. Pat. No. 3,141,662 (Wise) and DE 102015 215630 [now US 2018/0209194] (Rietdijk).

SUMMARY

In one exemplary embodiment, a power drive module for a vehicle power door includes a housing, a drive mechanism arranged in the housing and configured to move a drive element, and a brake assembly arranged in the housing. The brake assembly includes a brake ring operatively coupled to the drive mechanism. A brake band is wrapped about the brake ring and movable between a normally engaged position relative to the brake ring and a disengaged position relative to the brake ring. A brake release actuator is operatively connected to the brake band and configured to move the brake band between the engaged and disengaged positions with the brake ring in response to an electrical signal.

In a further embodiment of the above, the brake assembly is configured to be held in either the engaged position or the disengaged position with no electrical power to the brake assembly.

In a further embodiment of any of the above, the brake band includes first and second ends. The first end is secured to the housing. The second end is secured to a slide block that is slidably received in the housing. An energizing spring is arranged between the housing and the slide block to bias the brake ring to the engaged position.

In a further embodiment of any of the above, the brake release actuator includes a cam having a cam profile that is configured to engage a face of the slide block. The cam is configured to rotate about a pivot and the cam profile to slide along the face in response to the electrical signal.

In a further embodiment of any of the above, the cam includes teeth. The brake release actuator includes a worm shaft coupled to a motor. The worm shaft engages the teeth, and the motor is configured to drive the cam about the pivot in response to the electrical signal.

In a further embodiment of any of the above, the brake release actuator includes a cam stop mounted to the housing. The cam engages the cam stop with the brake band in the engaged position.

In a further embodiment of any of the above, the drive mechanism includes a drive gear, and the brake ring is operatively affixed to the drive gear.

In a further embodiment of any of the above, the drive mechanism includes a worm shaft coupled to a motor. The worm shaft engages the drive gear, and a gearbox is operatively connected between the drive gear and an output shaft.

In a further embodiment of any of the above, the power drive module includes a crank arm mounted to the output shaft and is connected to a link that is configured to be connected to a vehicle.

In one exemplary embodiment, a method of operating a vehicle door with an electric power drive module includes engaging a brake assembly to an engaged position to hold a door in an open or partially open position. The method also includes disengaging the brake assembly to a disengaged position to move the door. Power to the brake assembly is cut while maintaining both the engaged and disengaged positions.

In a further embodiment of the above, the engaging and disengaging steps include rotating a cam operatively connected to a brake band to selectively engage and disengage the brake band from a drive mechanism.

In a further embodiment of any of the above, the rotating step includes rotating the cam with a worm shaft.

In a further embodiment of any of the above, the rotating step includes operatively driving the worm shaft with a motor. The brake band is held in a disengaged position with a motor de-energized.

In a further embodiment of any of the above, the method includes the step of spring biasing the brake band to an engaged position that holds the drive mechanism against rotation.

In a further embodiment of any of the above, the rotating step includes sliding a cam surface across a face of a slide block that is secured to one end of the brake band, the cam countering the spring biasing step.

In a further embodiment of any of the above, the method includes the step of moving a vehicle door. The vehicle door moving step includes disengaging the brake band from the drive mechanism. The vehicle door moving step further includes rotating an output shaft with the drive mechanism with the brake band disengaged.

In a further embodiment of any of the above, the method includes the step of holding a vehicle door in at least a partially open position, wherein the vehicle door holding step includes rotating the cam to a cam stop. The brake band is spring biased to an engaged position that holds the drive mechanism against rotation.

In a further embodiment of any of the above, the method includes a step of checking a vehicle door. The vehicle door checking step includes moving the door with the drive mechanism in one of first and second directions. The brake band is engaged from the drive mechanism to hold the door in a desired position. The break band is released from the drive mechanism and moves the door with the drive mechanism in either of the first and second directions.

In one exemplary embodiment, a power drive module for a vehicle power door opening device includes a housing configured to be mounted to one of a vehicle body and a door. A drive mechanism is arranged in the housing. The drive mechanism includes a first motor operatively coupled to a gearbox having an output shaft. A linkage assembly is connected to the output shaft that is configured to be connected to the other of the vehicle body and the door. A brake assembly is arranged in the housing. The brake assembly includes a brake ring operatively coupled to the drive mechanism. A brake band is wrapped about the brake ring and movable between a normally engaged position relative to the brake ring and a disengaged position relative to the brake ring. A brake release actuator is operatively connected to the brake band and configured to move the brake band between the engaged and disengaged positions with the brake ring. A second motor is operatively coupled to the brake band.

In a further embodiment of the above, the brake assembly is configured to be held in both the engaged and the disengaged positions with no electrical power to the second motor.

In a further embodiment of any of the above, the brake band includes first and second ends. The first end is secured to the housing. The second end is secured to a slide block that is slidably received in the housing. An energizing spring is arranged between the housing and the slide block to bias the brake ring to the engaged position.

In a further embodiment of any of the above, the brake release actuator includes a cam having a cam profile that is configured to engage a face of the slide block. The cam is configured to rotate about a pivot and the cam profile to slide along the face. The cam includes teeth. The brake release actuator includes a worm shaft coupled to the second motor. The worm shaft engages the teeth. The second motor is configured to drive the cam about the pivot.

In a further embodiment of any of the above, the drive mechanism includes a drive gear. The brake ring is operatively affixed to the drive gear. The drive mechanism includes a worm shaft coupled to the second motor. The worm shaft engages the drive gear. A portion of the gearbox is operatively connected between the drive gear and the output shaft.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
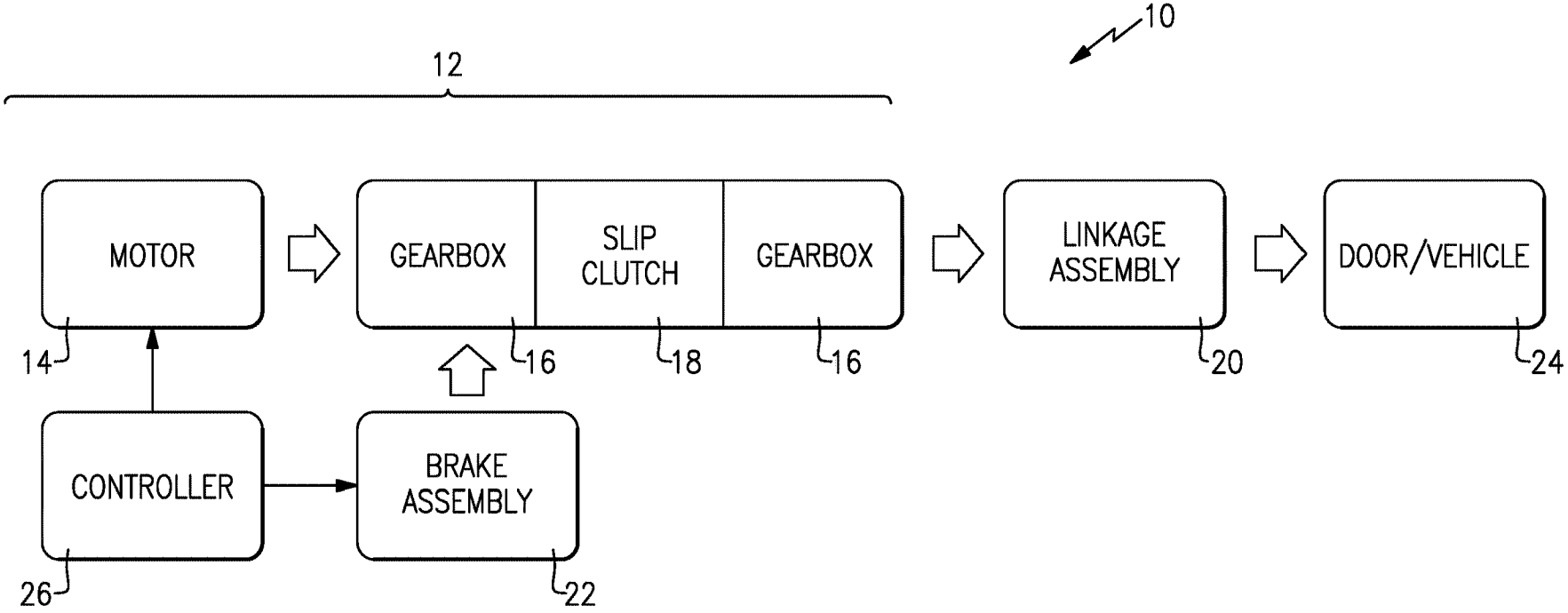
FIG. 1 is a schematic view of a door system.

A door system 10 for automatically opening, closing and/or holding a vehicle door 24 is schematically illustrated in FIG. 1. The system 10 includes a power drive module 12 having a motor 14, a planetary gearbox 16 with a slip clutch 18 that comprise a drive mechanism. The power drive module 12 opens the door 24 via a linkage assembly 20, which provides a drive element, in response to the electric motor 14 rotating a portion of the linkage assembly 20 through the gearbox 16 and the slip clutch 18.

A brake assembly 22 cooperates with a portion of the power drive module 12, for example, the gearbox 16 to arrest any rotational movement of the power drive module 12, which effectively holds the vehicle door 24 in an open or partially open position. A controller 26 is in communication with the motor 14 and the brake assembly 22 to coordinate operation during manual and/or automated movement of the door 24.

Figure 2B:
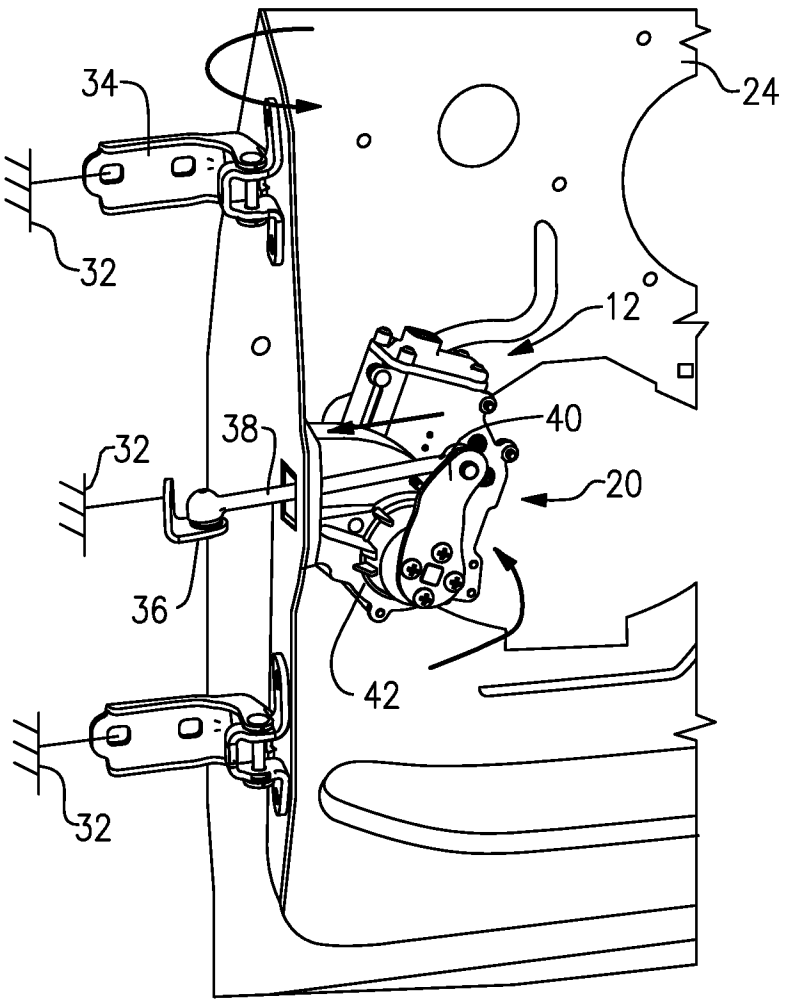
FIG. 2B is an enlarged view of a portion of the vehicle door shown in FIG. 2A.
Figure 2A:
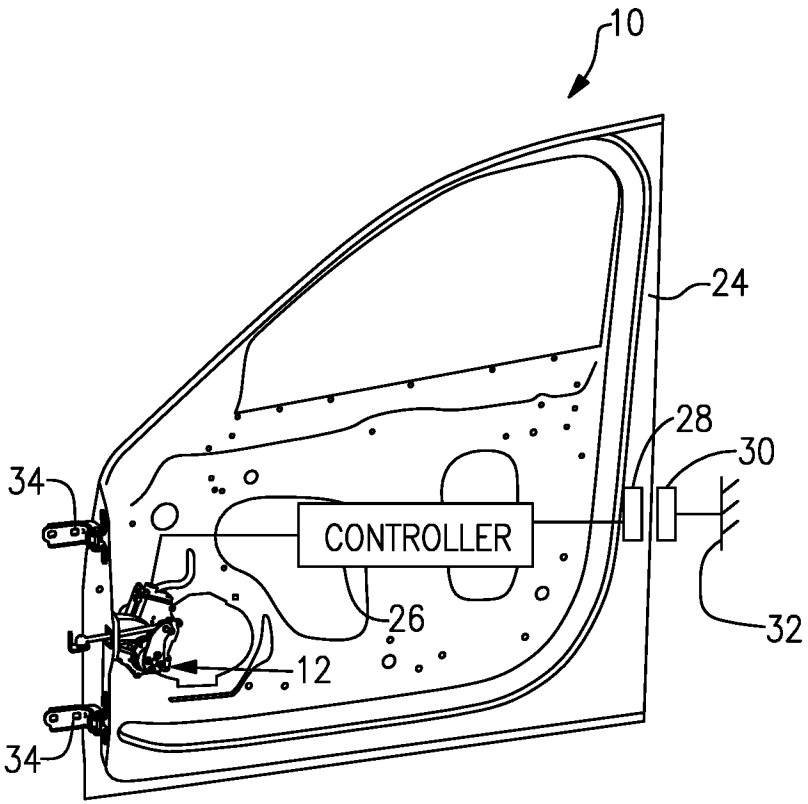
FIG. 2A is a schematic view of a vehicle door.

Referring to FIGS. 2A and 2B, a conventional automotive vehicle typically includes multiple doors 24 (one shown) used for egress and ingress to the vehicle passenger compartment and/or cargo area. In the example, the door 24 is a passenger door. The door 24 is pivotally mounted by hinges 34 to a vehicle frame 32, such as an A-pillar or B-pillar, about which the door is movable between opened and closed positions. The door 24 has a cavity that typically includes an impact intrusion beam, window regulator, and other devices (not shown). The power drive module 12 is arranged within the cavity, although the power drive module 12 can instead be arranged in the vehicle frame 32, if desired. Mounting the power drive module 12 near the hinges 34 minimizes the impact on door inertia.

The power drive module 12 is part of a door system 10 that permits automated opening and closing of the door 24 without the need of a user to manually push and pull on the passenger door, as is typical. However, the system 10 can be used as a conventional door, overriding the door check and automated opening and closing features. The system 10 may also act as a door hold, or door check, without the need of a typical door check that has discrete detents.

Referring to FIG. 2B, the power drive module 12 is connected to the vehicle frame 32 by the linkage assembly 20 via a bracket 36. The linkage assembly 20 transmits the opening and closing forces provided by the power drive module 12 to the vehicle frame and also holds the door 24 open when desired.

The controller 26, or electronic control unit (ECU), receives inputs from various components as well as sends command signals to the power drive module 12 to open and close the door 24 in response to a user request. An example methodology for controlling door motion is disclosed in International Patent Application No. WO2016/164,023, which is incorporated by reference herein in its entirety. A power supply (not shown) is connected to the controller 26, which selectively provides electrical power to the power drive module 12 in the form of commands, or electrical signals. A latch 28 is in communication with the controller 26. The latch 28, which is carried by the door 24 (FIG. 2A), is selectively coupled and decoupled to a striker 30 mounted to the vehicle frame 32. In the example, the latch 28 is a power pull-in latch. A switch (not shown) provides a first input to the system 10 indicative of a user request to automatically open or close the door 24.

Figure 3A:
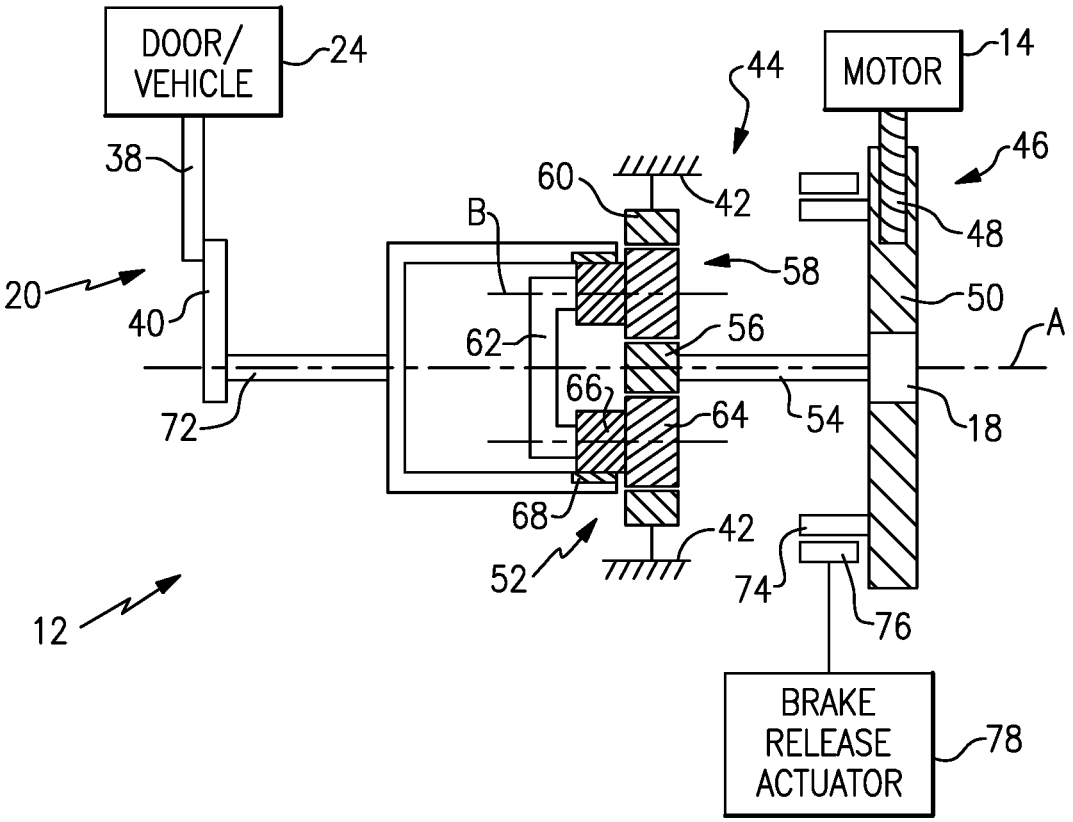
FIG. 3A is a schematic view of a gearbox and a brake assembly for a power drive module for use in automatically opening, closing and holding the vehicle door.
Figure 6:
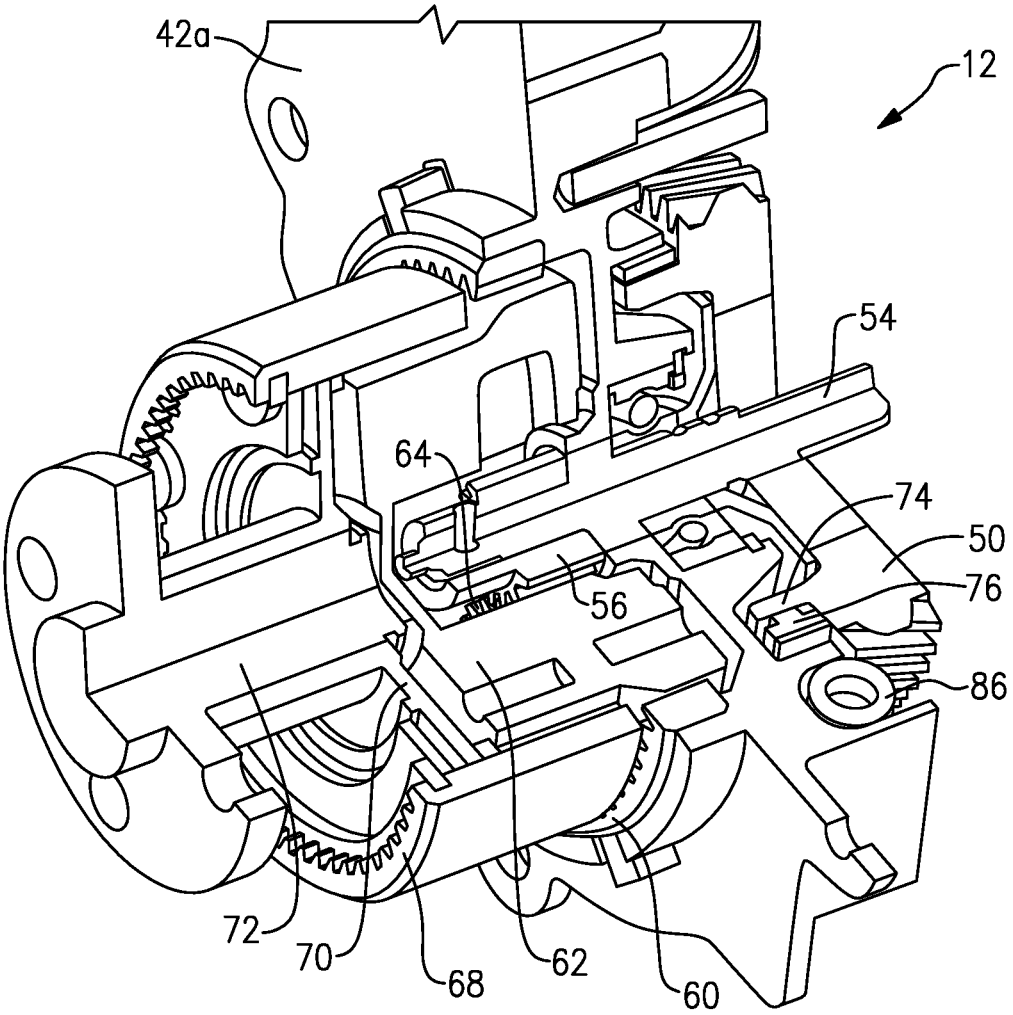
FIG. 6 is a partial cross-sectional view through a portion of the power drive module shown in FIG. 5.
Figure 8:
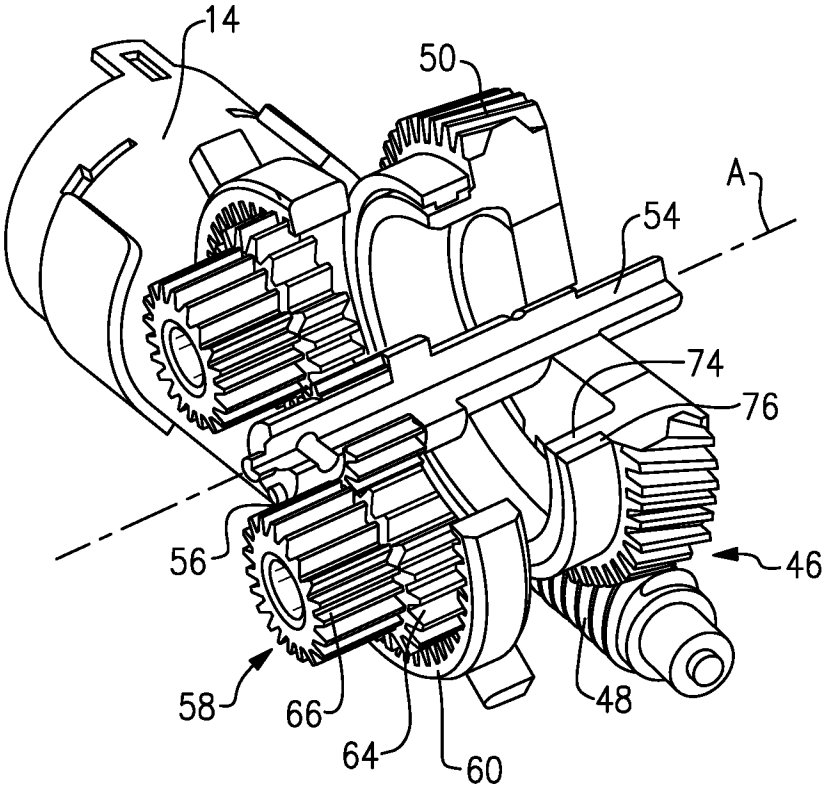
FIG. 8 is a perspective, partial cross-sectional view through a portion of the gearbox and the brake assembly.

Referring to FIGS. 3A, 6 and 8, the power drive module 12 includes a multi-stage gearbox 16 arranged within the housing 42. A first stage 44 of the gearbox 16 includes a worm drive 46 that includes a worm shaft 48 coupled to a worm gear 50, which provides a drive gear. The worm shaft 48 is rotationally driven by the motor 14, which corresponds to a first motor within the power drive module 12.

The worm gear 50 is connected to an input shaft 54 that is rotatable about an axis A. The input shaft 54 rotationally drives a compound epicyclic gear train 52 that has second and third stages. The second stage has a sun gear 56 mounted to the input shaft 54. The sun gear 56 mates with a first planetary gear set 64 of an intermediate gear set 58. The intermediate gear set 58 is mounted within a carrier 62, and each intermediate gear rotates about an axis B as the carrier 62 rotates about the axis A. The first planetary gear set 64 meshes with a first ring gear 60 that is fixed to the housing 42, preventing rotation of the first ring gear 60.

A second planetary gear set 66 of the intermediate gear set 58 is affixed to the first planetary gear set 64 and rotates therewith. The third stage is provided by the second planetary gear set 66, which meshes with a second ring gear 68. The crank arm 40 is secured to the output shaft 72, which applies an opening or closing force to the door 24 via the link 38. The output shaft 72 is carried by an output hub 70 arranged within the second ring gear 68.

In the example, a brake ring 74 extends from the worm gear 50. A brake band 76 is arranged about the brake ring 74 and is selectively engagable therewith in response to a brake release actuator 78. The brake ring 74 is provided on the first stage of the gearbox 16, thus requiring less brake force to arrest motion of the door 24 via the gearbox 16 than if used on the second and third stages where torque is greater.

Figure 5:
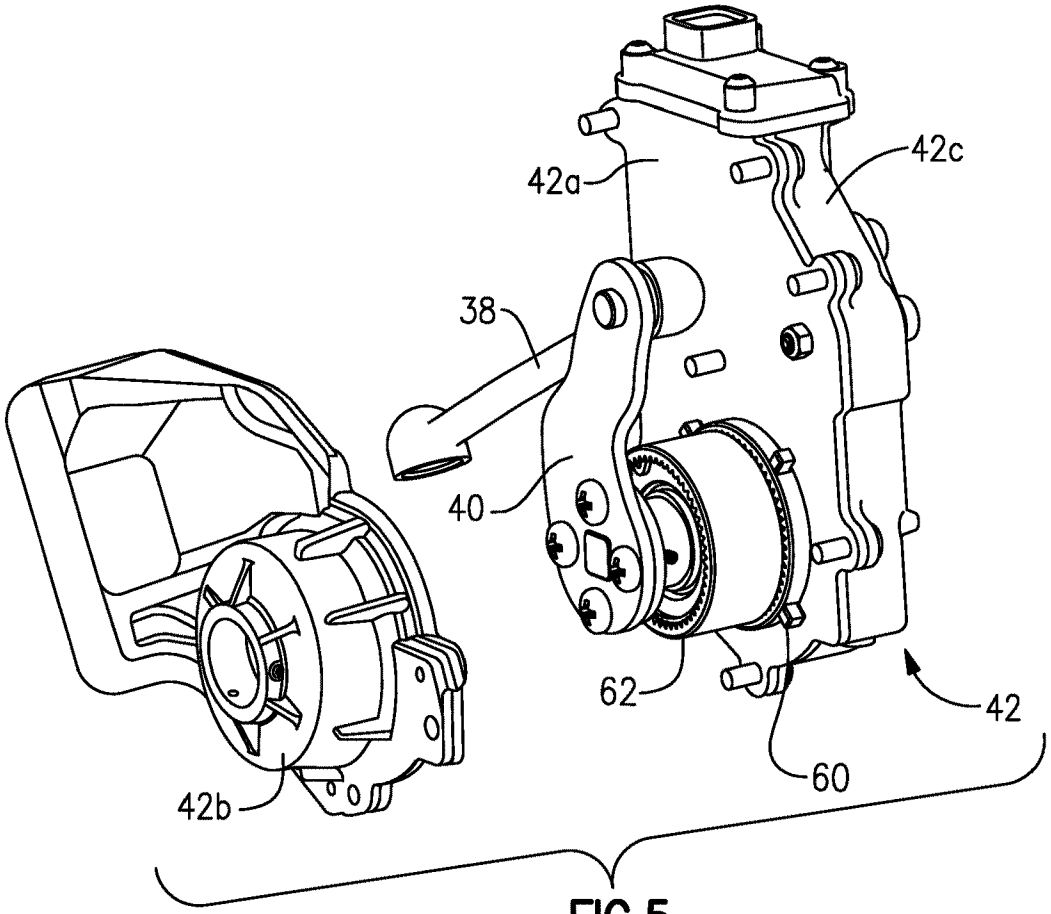
FIG. 5 is a partially exploded perspective view of the power drive module shown in FIG. 4.
Figure 4:
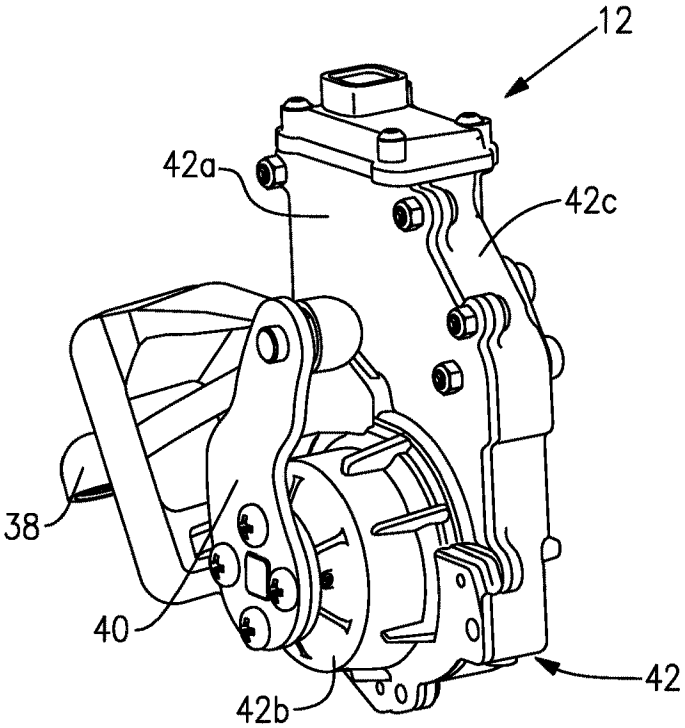
FIG. 4 is a perspective view of an example power drive module.

Referring to FIGS. 4 and 5, the housing 42 is constructed from multiple components, for example, a mounting plate 42*a* and first and second covers 42*b*, 42*c*. Aside from the worm shaft 48, which is arranged transverse to the axis A, the components of the gearbox 16 are coaxial with one another, with the axis B rotating about the axis A.

Figure 7:
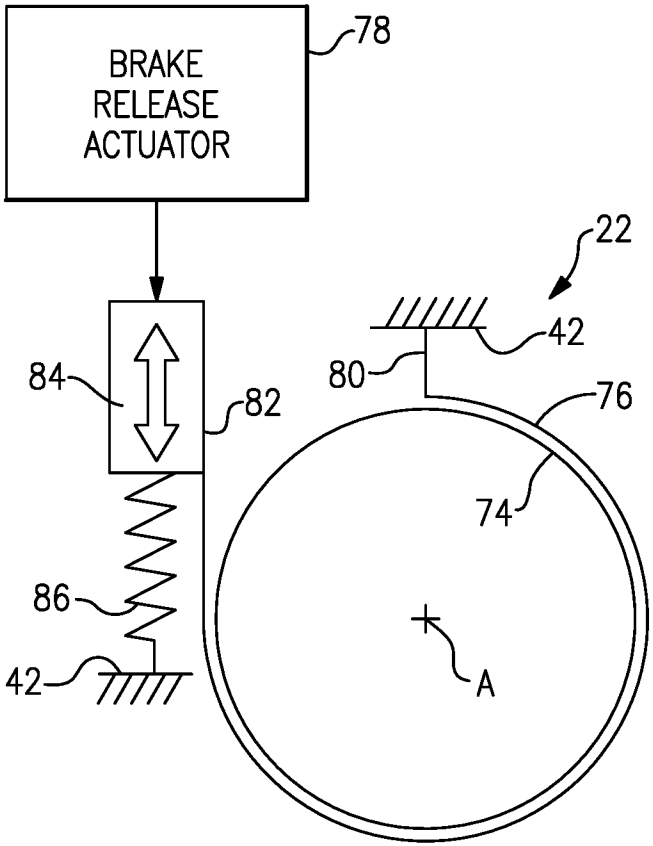
FIG. 7 is a schematic view of the brake assembly.

The brake assembly 22 is shown schematically in FIG. 7. The brake band 76 has first and second ends 80, 82. The first end 80 is affixed to the housing 42, and the second end 82 is affixed to a slide block 84. The slide block 84 is slidably arranged within a correspondingly shaped pocket in the housing 42. An energizing spring 86 is arranged between one end of the slide block 84 and a surface of the housing 42 to normally bias the brake band 76 into engagement with the outer diameter of the brake ring 74. Sufficient tension is provided on the second end 82 of the brake band 76 to prevent undesired rotation of the brake band 76, and in turn the gearbox 16, which prevents movement of the linkage assembly 20 and ultimately the door 24.

The slip clutch 18 permits slippage between the worm gear 50 and the input shaft 54 when the brake assembly 22 is engaged and power is lost during an electrical system failure. In this case, when the operator wants to open or close the door 24, the planetary gearbox 16 gets back-driven and the input shaft 54 slips in relation to the braked worm gear 50.

A brake release actuator 78 selectively cooperates with the slide block 84 to overcome the energizing spring 86 and move the brake band 76 from the engaged position to a disengaged position which permits the brake ring 74 to freely rotate with respect to the brake band 76.

Figure 3B:
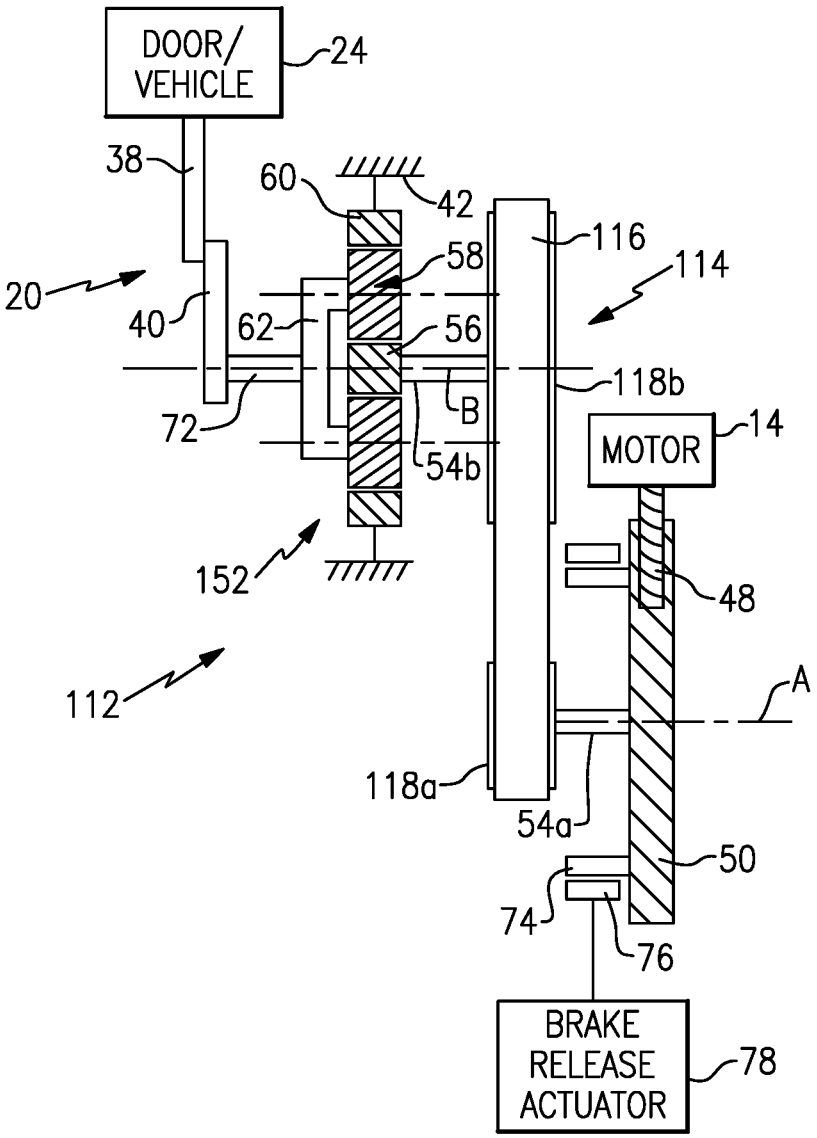
FIG. 3B is a schematic of a power drive module similar to that shown in FIG. 3A, but with a belt drive.

Like numerals are used in FIG. 3B to indicate like elements with respect to other disclosed embodiments. FIG. 3B illustrates a power drive module 112 that includes a belt drive 114. The motor 14 rotationally drives the worm shaft 48, which is coupled to the worm gear 50. The worm gear 50 is mounted to first input shaft portion 54*a* connected to a first pulley 118*a*. A belt 116 is wrapped about the first pulley 118*a* and a second pulley 118*b*, which is mounted to a second input shaft portion 54*b*. Rather than employing a compound planetary gear as shown in FIG. 3A, a single stage planetary gear 152 transmits the rotational drive from the second input shaft portion 54*b* to the output shaft 72.

Figure 9:
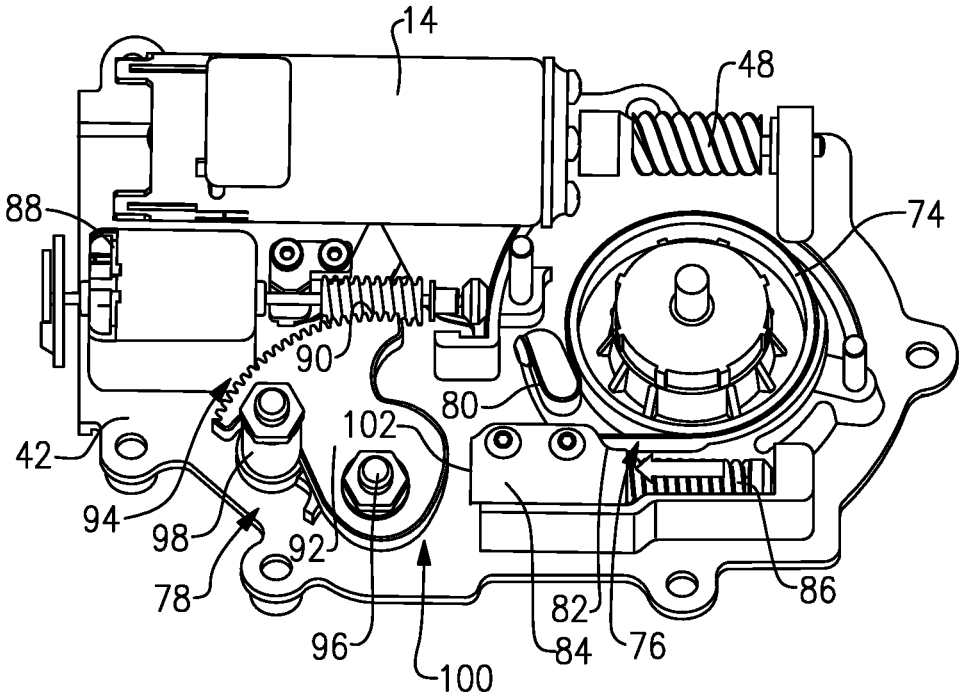
FIG. 9 illustrates a portion of the power drive module and the brake assembly in an engaged brake position.
Figure 10:
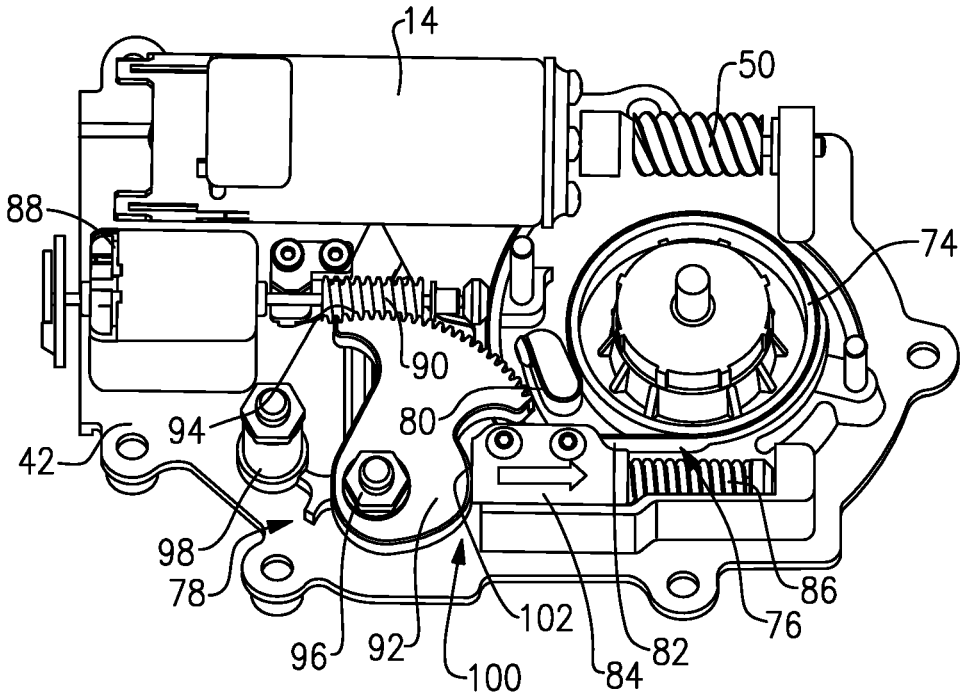
FIG. 10 illustrates the brake assembly shown in FIG. 9, but in the disengaged brake position.

The engaged and disengaged positions are respectively shown in FIGS. 9 and 10. Referring to FIG. 9, the brake release actuator 78 includes a brake motor 88, provided by a second electric motor, which rotationally drives a worm shaft 90. A cam 92 is supported for rotation about a pivot 96 mounted to the housing 42. The cam 92 includes teeth 94 engaged by the worm shaft 90. The cam 92 is shown fully retracted and in abutment with a cam stop 98 mounted to the housing 42. The cam 92 includes a cam profile 100, which is configured to slidably engage a face 102 of the slide block 84 arranged opposite of the energizing spring 86. Once in the engaged position, no electrical power is required to the brake release actuator 78 to hold the brake assembly 22 in the engaged position (i.e., the power may be cut to the brake motor 88).

In response to an electrical signal, the brake motor 88 rotationally drives the cam 92 about the pivot 96 via the worm shaft 90 from the retracted position shown in FIG. 9 to a position shown in FIG. 10. In the released or disengaged position shown in FIG. 10, the cam profile 100 progressively moves the slide block 84 to compress the energizing spring 86, which slackens the brake band 76 sufficiently to permit rotation of the brake ring 74 by the motor and gearbox 14, 16. Once in the disengaged position, no electrical power is required to the brake release actuator 78 to hold the brake assembly 22 in the disengaged position (i.e., the power may be cut to the brake motor 88).

The disclosed power drive module automatically moves the door open and closed with the vehicle on flat ground or grades that are common on public roads. The power drive module is also capable of holding the door in any open position as dictated by the system control program on flat ground or grades up to certain wind conditions, and can hold the door for long periods in an ajar position if the user desires so. The brake assembly 22 may be held in an engaged and a disengaged position with no electrical power to the brake release actuator 78. Overall, very little power is consumed by the power drive module 12, which contributes to the overall fuel efficiency of the vehicle. Moreover, the power drive module minimally resists manual operations and/or emergency operations via the slip clutch 18 when the system cannot be powered, such as may be the case after a vehicle accident.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A power drive module for a vehicle power door opening device, the power drive module comprising:

a housing;

a motor;

a drive mechanism arranged in the housing and configured to move a drive element; and a brake assembly arranged in the housing, the brake assembly including a brake ring operatively coupled to the drive mechanism, a brake band wrapped about the brake ring and movable between an engaged position relative to the brake ring and a disengaged position relative to the brake ring, and a brake release actuator operatively connected to the brake band and configured to move the brake band between the engaged and disengaged positions with the brake ring in response to an electrical signal, wherein the brake assembly arrests rotational movement of the drive mechanism in the engaged position and the brake assembly is configured to be held in both the engaged and disengaged positions without supply of electrical power.

2. The power drive module of claim 1, wherein the brake band includes first and second ends, the first end secured to the housing, the second end secured to a slide block that is slidably received in the housing, and an energizing spring is arranged between the housing and the slide block to bias the brake ring to the engaged position.

3. The power drive module of claim 2, wherein the brake release actuator includes a cam having a cam profile that is configured to engage a face of the slide block, and the cam is configured to rotate about a pivot and the cam profile to slide along the face in response to the electrical signal.

4. The power drive module of claim 3, wherein the cam includes teeth, and the brake release actuator includes a worm shaft coupled to the motor, the worm shaft engaging the teeth, and the motor is configured to drive the cam about the pivot in response to the electrical signal.

5. The power drive module of claim 3, wherein the brake release actuator includes a cam stop mounted to the housing, and the cam engages the cam stop with the brake band in the engaged position.

6. The power drive module of claim 1, wherein the drive mechanism includes a drive gear, and the brake ring is operatively affixed to the drive gear.

7. The power drive module of claim 6, wherein the drive mechanism includes a worm shaft coupled to a motor, the worm shaft engages the drive gear, and a gearbox is operatively connected between the drive gear and an output shaft.

8. The power drive module of claim 7, comprising a crank arm mounted to the output shaft and connected to a link that is configured to be connected to a vehicle.

9. A method of operating a vehicle door with the electric power drive module of claim 1, the method comprising:

engaging the brake assembly to an engaged position to hold the door in an open or partially open position;

disengaging the brake assembly to a disengaged position to move the door; and wherein power to the brake assembly is cut while maintaining both the engaged and disengaged positions.

10. The method of claim 9, wherein the engaging and disengaging steps include rotating a cam operatively connected to a brake band to selectively engage and disengage the brake band from the drive mechanism.

11. The method of claim 10, wherein the rotating step includes rotating the cam with a worm shaft.

12. The method of claim 10, wherein the rotating step includes operatively driving the worm shaft with the motor, and the brake band is held in a disengaged position with the motor de-energized.

13. The method of claim 12, wherein the rotating step includes sliding a cam profile across a face of a slide block that is secured to one end of the brake band, the cam countering the spring biasing step.

14. The method of claim 10, comprising the step of spring biasing the brake band to an engaged position that holds the drive mechanism against rotation.

15. The method of claim 10, comprising the step of moving a vehicle door, wherein the vehicle door moving step includes:

disengaging the brake band from the drive mechanism; and rotating an output shaft with the drive mechanism with the brake band disengaged.

16. The method of claim 10, comprising the step of holding a vehicle door in a partially open position or a fully open position, wherein the vehicle door holding step includes:

rotating the cam to a cam stop; and spring biasing the brake band to an engaged position that holds the drive mechanism against rotation.

17. The method of claim 10, comprising a step of checking a vehicle door, wherein the vehicle door checking step includes:

moving the door with the drive mechanism in one of first and second directions;

engaging the brake band from the drive mechanism to hold the door in a desired position;

releasing the brake band from the drive mechanism; and moving the door with the drive mechanism in either of the first and second directions.

18. A power drive module of claim 1, wherein the housing is configured to be mounted to one of a vehicle body and a door, the drive mechanism includes a first motor operatively coupled to a gearbox having an output shaft; and comprising a linkage assembly connected to the output shaft configured to be connected to the other of the vehicle body and the door; and a second motor operatively coupled to the brake band, wherein the brake assembly is configured to be held in both the engaged and the disengaged positions with no electrical power to the second motor.

19. The power drive module of claim 18, wherein the brake band includes first and second ends, the first end secured to the housing, and the second end secured to a slide block that is slidably received in the housing, and an energizing spring is arranged between the housing and the slide block to bias the brake ring to the engaged position.

20. The power drive module of claim 19, wherein the brake release actuator includes a cam having a cam profile that is configured to engage a face of the slide block, the cam is configured to rotate about a pivot and the cam profile to slide along the face, the cam includes teeth, and the brake release actuator includes a worm shaft coupled to the second motor, the worm shaft engaging the teeth, and the second motor is configured to drive the cam about the pivot.

21. The power drive module of claim 18, wherein the drive mechanism includes a drive gear, the brake ring is operatively affixed to the drive gear, the drive mechanism includes a worm shaft coupled to the second motor, the worm shaft engages the drive gear, and a portion of the gearbox is operatively connected between the drive gear and the output shaft.

* * * * *